United States Patent [19]

Kaminaka

[11] Patent Number: 4,798,927

[45] Date of Patent: Jan. 17, 1989

[54] COMBINED MICROWAVE AND ELECTRIC OVEN WITH INTERMITTENT POWER SUPPLY TO BOTH MICROWAVE AND ELECTRIC HEATING ELEMENTS

[75] Inventor: Ikuyasu Kaminaka, Osaka, Japan

[73] Assignee: Sharp Kabushiki Kaisha, Osaka, Japan

[21] Appl. No.: 18,464

[22] Filed: Feb. 25, 1987

[30] Foreign Application Priority Data

Feb. 28, 1986 [JP] Japan ..... 61-45001

[51] Int. Cl.[4] ..... H05B 6/68

[52] U.S. Cl. ..... 219/10.55 B; 219/10.55 R; 219/486

[58] Field of Search ..... 219/10.55 B, 10.55 R, 219/10.55 C, 10.55 E, 10.55 M, 486, 483; 307/38, 41

[56] References Cited

U.S. PATENT DOCUMENTS

| | | | |
|---|---|---|---|
| 2,744,990 | 5/1956 | Schroeder | 219/10.55 B |
| 4,196,330 | 4/1980 | Payne | 219/10.55 B |
| 4,345,134 | 8/1982 | Tanaka et al. | 219/10.55 B |
| 4,463,238 | 7/1984 | Tanabe | 219/10.55 B |
| 4,469,926 | 9/1984 | Komuro | 219/10.55 B |

FOREIGN PATENT DOCUMENTS

| | | | |
|---|---|---|---|
| 0023827 | 2/1981 | European Pat. Off. . | |
| 0124202 | 11/1984 | European Pat. Off. . | |
| 2911929 | 10/1980 | Fed. Rep. of Germany . | |
| 2857367 | 8/1982 | Fed. Rep. of Germany . | |
| 54-10451 | 1/1979 | Japan | 219/10.55 B |
| 54-65850 | 5/1979 | Japan | 219/10.55 B |
| 54-101527 | 8/1979 | Japan | 219/10.55 B |
| 54-128037 | 10/1979 | Japan | 219/10.55 B |
| 1312992 | 4/1973 | United Kingdom . | |
| 1394311 | 5/1975 | United Kingdom . | |

*Primary Examiner*—Philip H. Leung

*Attorney, Agent, or Firm*—Birch, Stewart, Kolasch & Birch

[57] ABSTRACT

A microwave oven includes a heating chamber in which food is heated, a high frequency heating circuit for supplying high frequency energy to the heating chamber, a thermal heater provided in each of the upper and lower areas of the heating chamber, a switching circuit for selecting the high frequency heating circuit or the thermal heaters, a first switching circuit for permitting intermittent power to the high frequency heating circuit when the high frequency heating circuit is selected by the switching circuit, a second switching circuit connected in parallel with the first switching circuit so as to provide a bypass of the first switching circuit when closed, a first contact mounted in the first switching circuit to permit intermittent power supply to one of the two thermal heaters in the heating chamber, and a second contact mounted in the second switching circuit to provide a bypass of the first contact.

3 Claims, 3 Drawing Sheets

COMBINED MICROWAVE AND ELECTRIC OVEN WITH INTERMITTENT POWER SUPPLY TO BOTH MICROWAVE AND ELECTRIC HEATING ELEMENTS

BACKGROUND OF THE INVENTION

The present invention relates to a microwave oven with toasting and baking functions having an upper and lower heater in the heating chamber, or particularly to a microwave oven having a circuit for periodically energizing and de-energizing one of the two heaters.

Typically, a microwave oven with toasting and baking functions comprises the circuitry shown in FIG. 4, and controls, according to the selected cooking mode, the power supply to upper and lower heating elements (50) and (51) in the heating chamber (not shown) and to high frequency heating means (56) comprising a magnetron (52), a high voltage transformer (53), a high voltage capacitor (54) and a high voltage diode (55). The cooking mode is selected from among toasting, baking, defrosting and high-frequency heating (hereinafter referred to as microwave heating) modes.

The operation of the electrical elements in the baking mode is described with reference to FIG. 4.

When the baking mode is selected, the N.O. contact (57*a*) of the selector switch (57) is closed. The toasting switch (58) and the defrost-cancelling switch (59) are then closed interlocking with the N.O. contact (57*a*). To control the temperature in the heating chamber (not shown), the oil thermostat (60) provided in the heating chamber is adjusted to set the heating temperature.

When heating time is set by a timer (61), the timer contact (61*a*) closes so that power is supplied to the upper and lower heating elements (50) and (51) arranged in the heating chamber. The oil thermostat (60) is turned OFF when the temperature in the heating chamber rises above the setting, and turned ON when the heating temperature drops to the setting, thus maintaining the heating temperature at the preset value. When the preset heating time has elapsed, the timer contact (61*a*) opens, terminating the cooking operation.

However, in a microwave oven with the above circuitry in which the power supply to the two heaters is turned ON and OFF around the preset heating temperature, the radiant heat is too large for baking, say, cake, often causing cracks in the cake surface.

One possible measure against this is to lower the heating temperature or to keep the heaters away from the food. These measures have the problems that the cooking operation takes longer as the heating temperature is lowered, and the remoter the heaters are from the food, the longer it takes in toasting food, sacrificing the food taste.

SUMMARY OF THE INVENTION

In view of the above, an object of the present invention is to provide a microwave oven capable of changing the energization period of the heaters according to the cooking mode while keeping the oven temperature constant at a preset value.

Another object of the present invention is to provide a microwave oven capable of baking food such as cake optimally without increasing the cooking time.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The microwave oven of the present invention comprises a heating chamber in which food is to be heated, high frequency heating means for supplying high-frequency energy to the heating chamber, a heater arranged in each of the upper and lower areas of the heating chamber, selector switch means for switching power to either the high frequency heating means or to the heaters, first switch means to permit intermittent power to the high frequency heating means when the selector switch means is set to the high frequency heating means side, second switch means connected in parallel with the first switch means so as to provide a bypass circuit of the first switch means when closed, a contact provided in the first switch means to permit intermittent energization of the upper heater, and a contact mounted in the second switch means so as to provide a bypass circuit of the contact of the first switch means.

Since the upper heater is energized intermittently because of the function of the contact of the first switch means, it generates smaller radiant heat than it does when energized continuously, which prevents food from being heated excessively.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

An embodiment of the present invention is described in detail below with reference to the accompanying drawings. It is not intended, however, that the present invention be limited to the embodiment presented below.

Figure 1:
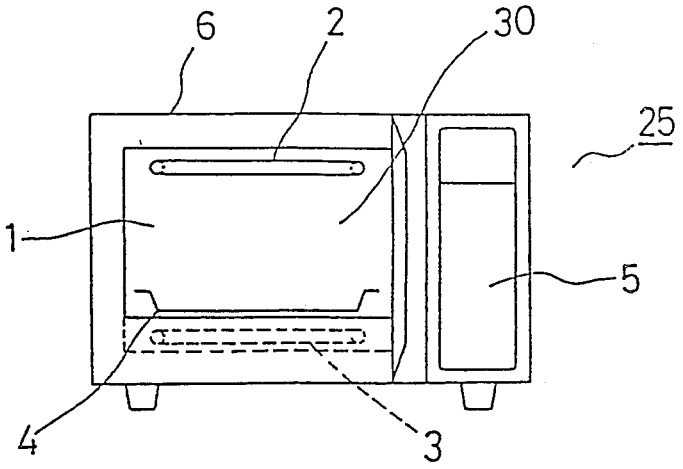
FIG. 1 is a front view of a microwave oven as an embodiment of the present invention.

Referring to FIG. 1, food to be heated is placed in a heating chamber (1). Heating elements such as sheathed heaters (hereinafter called heaters) (2) and (3) are provided each in the upper and lower parts of the heating chamber (1). A turntable (4) on which to put food is positioned over the lower heater (3). The turntable (4) has holes through which the radiant heat of the lower heater (3) reaches the food. An outer casing (6) has an operation panel (5) with various switches (not shown) and indicators (not shown) provided thereon.

Figure 2:
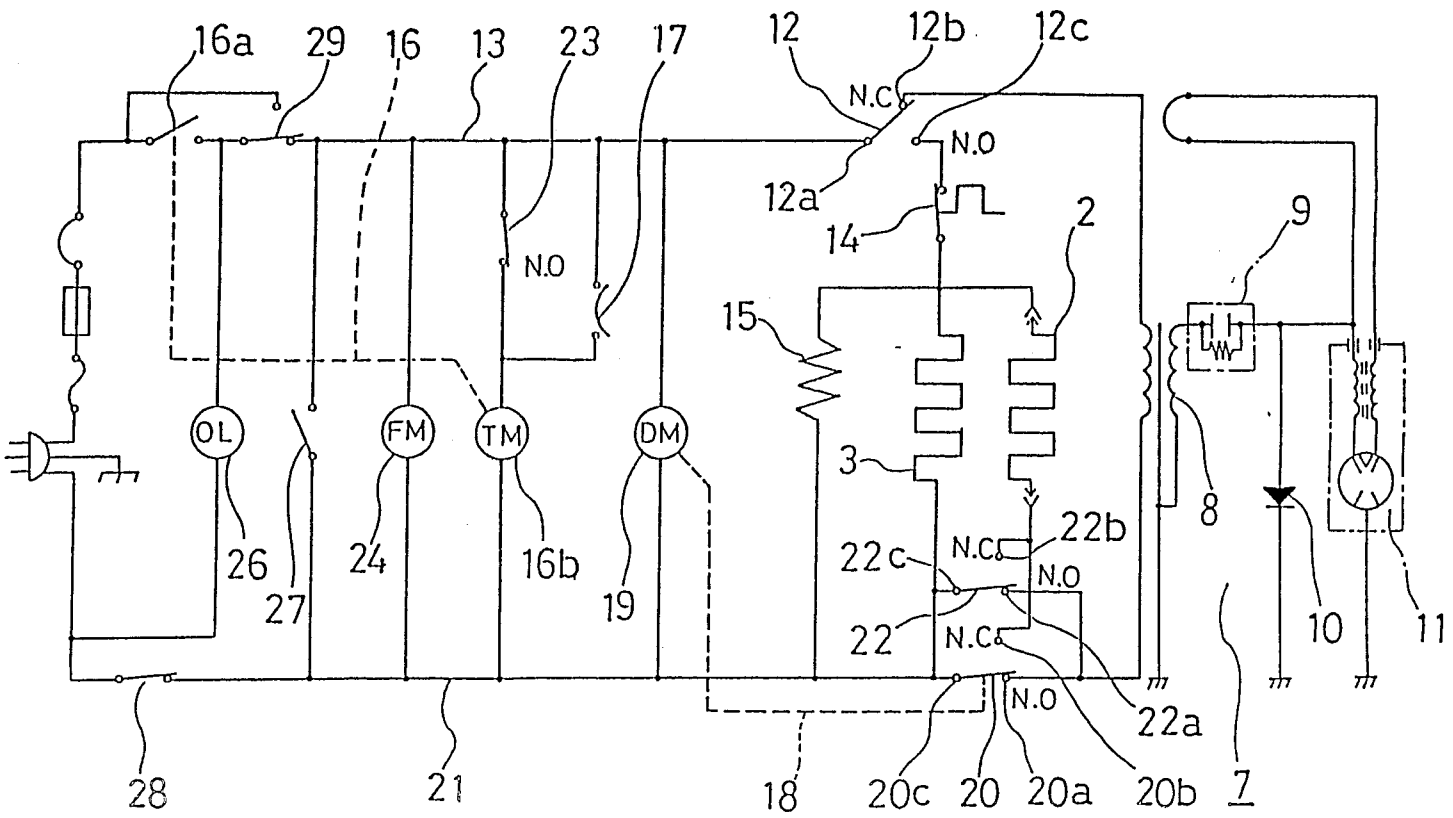
FIG. 2 is an electrical circuit diagram of the microwave oven of FIG. 1.
Figure 4:
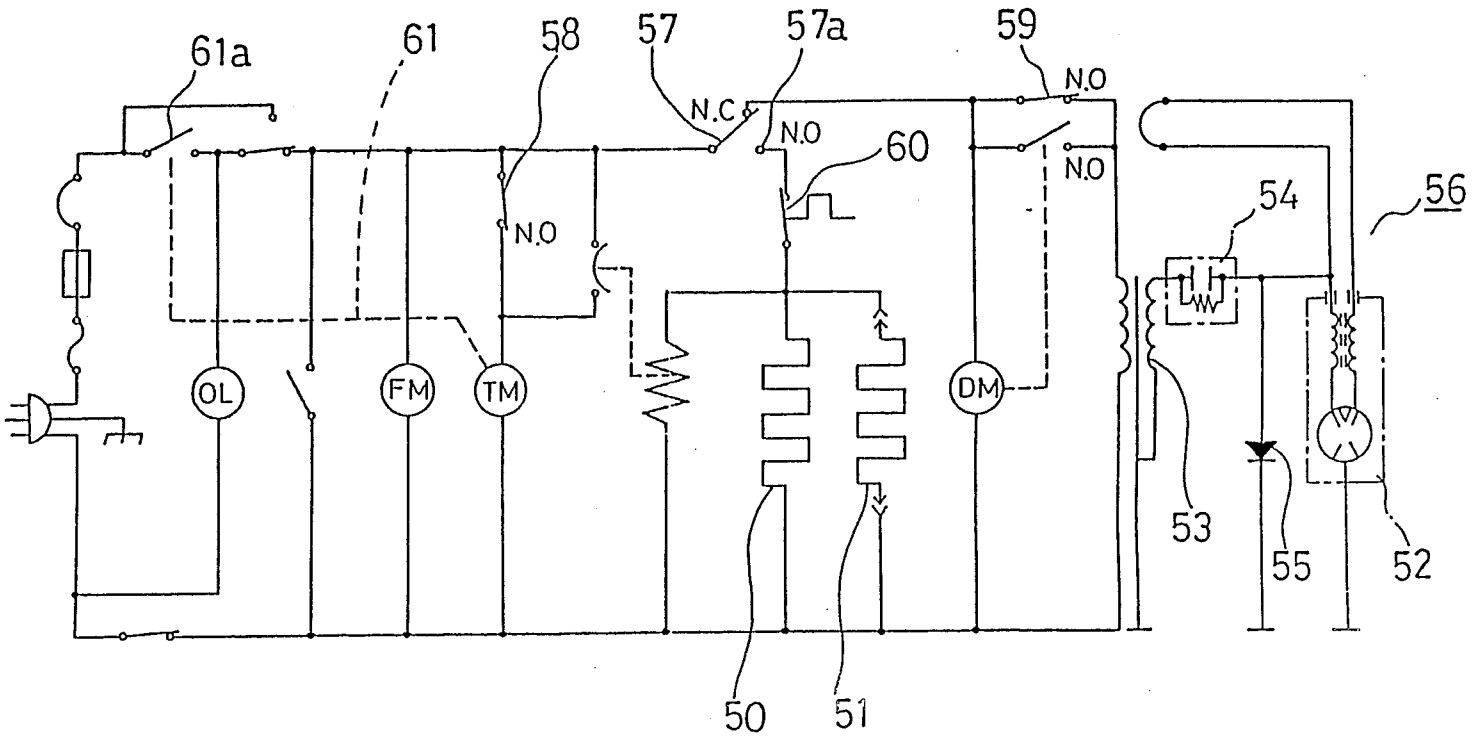
Fig. 4 PRIOR ART
FIG. 4 is an electrical circuit diagram of a conventional microwave oven, for comparison with the circuit diagram of the microwave oven of the present invention.

FIG. 2 shows the electrical circuit of the embodiment. A high frequency heating means such as a microwave heating means (7) comprises a high voltage transformer (8), a high voltage capacitor (9) connected to the secondary side of the high voltage transformer (8), a high voltage diode (10) and a magnetron (11). High frequency energy such as microwave energy supplied through a wave guide (not shown) from the high frequency heating means (7) to the heating chamber (1).

Selector switch means (12) (hereinafter referred to as a selector switch) has a common contact (12*a*) connected to a first power line (13), an N.C. contact (12*b*) connected to the primary side, voltage transformer (8) of the high and an N.O. contact (12*c*) connected through an oil thermostat (14) to the heaters (2) and (3) and to a cement resistor (15). The oil thermostat (14) is mounted in the heating chamber (1) to control the temperature of the heating chamber (1) in the baking mode. It can be set from the exterior. The cement resistor (15) is mounted adjacent to a thermal reed switch (17) connected to a timer motor (16*b*) of a timer (16) with which heating time is set. The cement resistor (15) serves to control the heating period in the toasting mode, preventing the food from being toasted irregularly due to temperature variations in the heating chamber (1). First switch means (hereinafter referred to as a defrost switch) (18) comprises a motor (19) and a contact system (20) made of a micro switch, for example, which opens or closes in response to the rotation of a cam mounted on the motor shaft. The contact system (20) comprises an N.O. contact (20*a*) connected to the primary side of the high voltage transformer (8), and N.C. contact (20*b*) connected to the heater (2) and a common contact (20*c*) connected to a second power line (21). A second switch means (hereinafter called a defrost-cancelling switch) (22) is connected in parallel with the contact system (20). The defrost-cancelling switch (22) comprises an N.O. contact (22*a*) connected to the primary side of the high voltage transformer (8), an N.C. contact (22*b*) connected to the heater (2) and a common contact (22*c*) connected to the second power line (21). A toast switch (23) is connected in parallel with the thermal reed switch (17) and opens only in the toasting mode. (24) is a fan motor for cooling the entire microwave oven (25). (26) is an oven lamp for illuminating the heating chamber (1). (27), (28) and (29) are safety switches operating when the oven door (30) is opened. A timer contact (16*a*) is connected to the first power line (13).

The selector switch (12), the defrost-cancelling switch (22) and the toast switch (23) operate as shown in Table 1 below, interlocking mechanically with one another.

TABLE 1

| | Switch | | |
|---|---|---|---|
| Cooking Mode | Selector Switch (12) | Toast Switch (23) | Defrost-Cancelling Switch (22) |
| Defrosting | N.C. contact (12b) ON | ON | N.C. contact (22b) ON |
| Microwave heating | N.C. contact (12b) ON | ON | N.O. contact (22a) ON |
| Baking | N.O. contact (12c) ON | ON | N.O. contact (22a) ON |
| Toasting | N.O. contact (12c) ON | OFF | N.C. contact (22b) ON |

Operation of the present invention is described now for each cooking mode.

Figure 3:
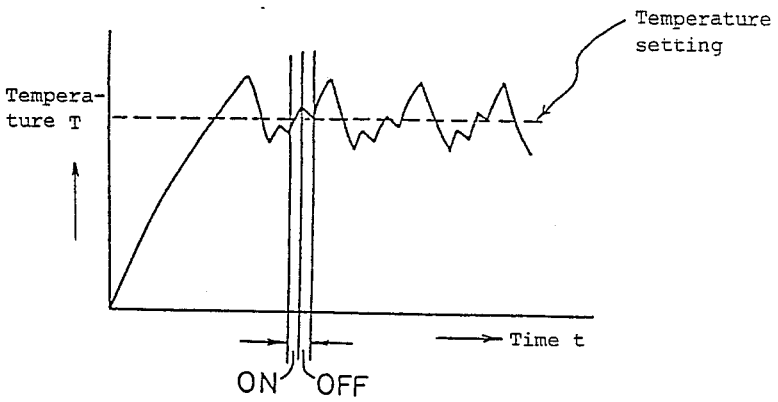
FIG. 3 is a graph showing temperature variation in the heating chamber the baking mode.

In the baking mode, when a heating time is set, the N.O. contact (12*c*) of the selector switch (12) is closed. Then the timer contact (16*a*) is closed so that power is supplied to the lower heater(3). The motor (19) of the defrost switch means (18) is also energized, so that the N.C contact (20*b*) of the contact system (20) of the defrost switch means (18) is closed, permitting power to be supplied for a specified period to the heater (2). Then, the N.C. contact (20*b*) is opened and the N.O. contact (20*a*) is closed so that the power supply to the heater (2) is cut off. The period of energization and de-energization of the heater (2) is determined by the configuration of the cam mounted on the motor (19). The above energization and de-energization cycle is repeated periodically until the preset heating time elapses, permitting intermittent power supplied to the heater (2). Consequently, the temperature in the heating chamber (1) is maintained around the value set for the oil thermostat (14) in such a manner that the temperature rises with the N.C. contact (20*b*) ON, and drops with the N.C. contact (20*b*) OFF while the oil thermostat (14) is turned ON, and drops when the oil thermostat (14) is turned OFF, as shown in FIG. 3, whereby the food is baked desirably.

Operation of the present invention for other cooking modes is as follows.

When the defrosting mode is selected, the N.C. contact (12*b*) of the selector switch (12) is closed. The toast switch (23) and the N.C. contact (22*b*) of the defrost-cancelling switch (22) are closed, interlocking with the selector switch (12). When heating time is set by the timer (16), the timer contact (16*a*) is closed so that voltage is applied through the selector (12) to the high voltage transformer (8), oscillating the magnetron (11). Since the N.O. contact (22*a*) opens and closes periodically as the motor (19) of the defrost switch (18) rotates, oscillation of the magnetron (11) is intermittent. When the preset heating time elapses, the timer contact (16*a*) opens, terminating the defrosting operation.

When the microwave heating mode is selected, the N.C. contact (12*b*) of the selector switch (12) and the toast switch (23) are closed as in the defrosting mode. The N.O. contact (22*a*) of the defrost-cancelling switch (22) is closed, providing a bypass of the contact system (20). Accordingly, regardless of the position of the defrost switch means (18), the magnetron (11) is oscillated continuously until the timer contact (16*a*) opens.

In the toasting mode, the N.O. contact (12*c*) of the selector switch (12) and the N.O. contact (22*a*) of the defrost-cancelling switch (22) are closed while the toast switch (23) is opened. With this state, if the timer contact (16*a*) is closed by setting the timer (16), the timer motor (16*b*) will not be operated although the heaters (2) and (3) are energized. This makes it possible to control the toasting time so as to toast food uniformly for an initial and subsequent toasting operation. Specifically, in the initial toasting operation, the thermal reed switch (17) adjacent to the heating time-collecting cement resistor (15) is open in the early stage because the temperature is below the operating temperature. When the temperature of the cement resistor (15) rises to the operating temperature of the thermal reed switch (17), the thermal reed switch (17) is closed, thus actuating the timer motor (16*b*). When the preset heating time has elapsed, the timer contact (16*a*) is opened, terminating the toasting operation. In the second toasting operation, the temperature of the cement resistor (15) should already be sufficiently high enough to close the thermal reed switch (17). The timer motor (16*b*) is therefore actuated from the beginning, supplying power to the heaters (2) and (3) until the preset heating time elapses.

Therefore, when the user wants to cook several slices (loaves) of bread in continuous toasting operations he (or she) needs to set a heating time only in the initial toasting operation. With the same heating time setting, the heating time is controlled automatically for each toasting operation so that all the slices (loaves) of bread are toasted uniformly.

In the toasting mode, intermittent energization of the heaters (2) and (3) would result in longer heating time, causing bread to be dried to the interior and thus impairing the taste. To avoid this, the oil thermostat (14) of the present invention is designed to be set to the maximum value when the toasting mode is selected, so that the oil thermostat (14) is not actuated in the toasting mode.

According to the present invention, as understood from the above, the upper heater is intermittently energized at a specified frequency in the baking mode, preventing the temperature of the heating chamber from rising excessively. Therefore, the microwave oven of the present invention is capable of baking food such as cake optimally without causing surface cracks.

The heaters 2 and 3 may be thermal heaters.

While only certain embodiments of the present invention have been described, it will be apparent to those skilled in the art that various changes and modifications may be made therein without departing from the spirit and scope of the present invention as claimed.

What is claimed is:

1. A microwave oven, comprising:

a heating chamber in which food is heated;

microwave heating means for supplying high frequency energy to the heating chamber;

a first thermal heater provided in an upper area of the heating chamber;

a second thermal heated provided in a lower area of the heating chamber;

selector switch means for selectively applying power to said microwave heating means or said first and second thermal heaters;

means for intermittently cutting off power to said microwave heating means when selected by said selector switch means, and for intermittently cutting off power to said first thermal heater when selected by said selector switch means; and means for selectively bypassing said intermittent cutting-off means to permit continuous power to be supplied to said microwave heating means or said first thermal heater when selected by said selector switch means.

2. A microwave oven as defined in claim 1, wherein said intermittent cutting-off means comprises a first switch alternately connecting said microwave heating means and said first thermal heater in circuit with a power supply.

3. A microwave oven as defined in claim 2, wherein said selectively bypassing means comprises a second switch connected in parallel with said first switch and having contacts connecting either said microwave heating means or said first thermal heater in circuit with said power supply.

* * * * *